US005458270A

United States Patent [19]

Tsao

[11] Patent Number: 5,458,270

[45] Date of Patent: Oct. 17, 1995

[54] FOLDABLE LIQUID CONTAINER FOR PREVENTING LEAKAGE

[76] Inventor: Chung-Piao Tsao, c/o Hung Hsing Patent Service Center, P.O. Box 55-1670, Taipei, Taiwan

[21] Appl. No.: 374,335

[22] Filed: Jan. 17, 1995

[51] Int. Cl.[6] ..... B65D 5/462; B65D 5/24

[52] U.S. Cl. ..... 229/114; 229/117.15; 229/155; 229/188

[58] Field of Search ..... 229/114, 117.14, 229/117.15, 117.22, 155, 188

[56] References Cited

U.S. PATENT DOCUMENTS

| | | | |
|---|---|---|---|
| 613,520 | 11/1898 | Keys | 229/188 |
| 762,966 | 6/1904 | Webb | 229/188 |
| 1,020,878 | 3/1912 | Bendelari | 229/188 |
| 1,058,408 | 4/1913 | Chase | 229/114 |
| 2,341,762 | 2/1944 | Conklin | 229/188 |
| 2,909,105 | 10/1959 | Lawrence | 229/188 |
| 3,008,626 | 11/1961 | Lawrence | 229/188 |
| 4,238,069 | 12/1980 | Morris, Jr. | 229/188 |
| 5,127,519 | 7/1992 | Tsao | 229/117.14 |
| 5,267,644 | 12/1993 | Tsao | 229/117.14 |
| 5,275,331 | 1/1994 | Chung-Piao | 229/117.14 |

*Primary Examiner*—Gary E. Elkins

[57] ABSTRACT

A foldable liquid container includes a bottom wall, four side walls hingedly secured to the bottom wall, four foldable web members each web member hingedly secured between every two neighboring side walls, two half covers respectively hingedly secured to two opposite side walls for shielding a top opening of the four side walls and two handle members respectively hingedly secured to the other two opposite side walls for carrying the container when upwardly erecting the side walls for setting up the container as tetrahydron shaped by folding each foldable web member into the assembled container to be contacted with a side wall secured with the half cover. Each half cover is cut with two sets of tongue slits each set including a lower slit and an upper slit, and each web member having a tongue portion protruding outwardly upwardly to be inserted through the lower and upper slits to be interlocked into the lower and upper slits for firmly setting up the container. The assembled container is provide for filling liquid material without leakage at a level coplanar to an upper edge portion of each side wall of the assembled container.

9 Claims, 6 Drawing Sheets

FOLDABLE LIQUID CONTAINER FOR PREVENTING LEAKAGE

BACKGROUND OF THE INVENTION

U.S. Pat. No. 1,985,111 to M. R. Shofer et al. disclosed a liner for shipping containers including a bottom, a pair of side walls, a pair of end walls, and four corner segments foldably forming a container for packing and shipping purposes. Each corner segment has a pair of tongues 26 so that the overlapped tongues 26 may be inserted into each slit 24 cut in the corner segment for assembling a rectangular container as shown in their FIG. 1 for lining, packing and shipping uses. However, each L-shaped slit 24 cut in the corner segment is positioned below an upper edge of each side wall 14, 15, whereby if such a container is served for filling liquid material in the container, the liquid material will be easily leaked outwardly through the slits 24, unless the filling level is below the slits 24. A lower filling level below the slits 24 will decrease the storing capacity or content within the container. It is therefore not suitable for providing the container of U.S. Pat. No. 1,985,111 as a container for filling liquid material in the container.

SUMMARY OF THE INVENTION

The object of the present invention is to provide a foldable liquid container including a bottom wall, four side walls hingedly secured to the bottom wall, four foldable web members each web member hingedly secured between every two neighboring side walls, two half covers respectively hingedly secured to two opposite side walls for shielding a top opening of the four side walls and two handle members respectively hingedly secured to the other two opposite side walls for carrying the container when upwardly erecting the side walls for setting up the container as tetrahydron shaped by folding each foldable web member into the assembled container to be contacted with a side wall secured with the half cover which is cut with two sets of tongue slits each set including a lower slit and an upper slit, and each web member having a tongue portion protruding outwardly upwardly to be inserted through the lower and upper slits to be interlocked into the lower and upper slits for firmly setting up the container, adapted for filling liquid material without leakage at a level coplanar to an upper edge portion of each side wall of the assembled container.

DETAILED DESCRIPTION

Figure 1:
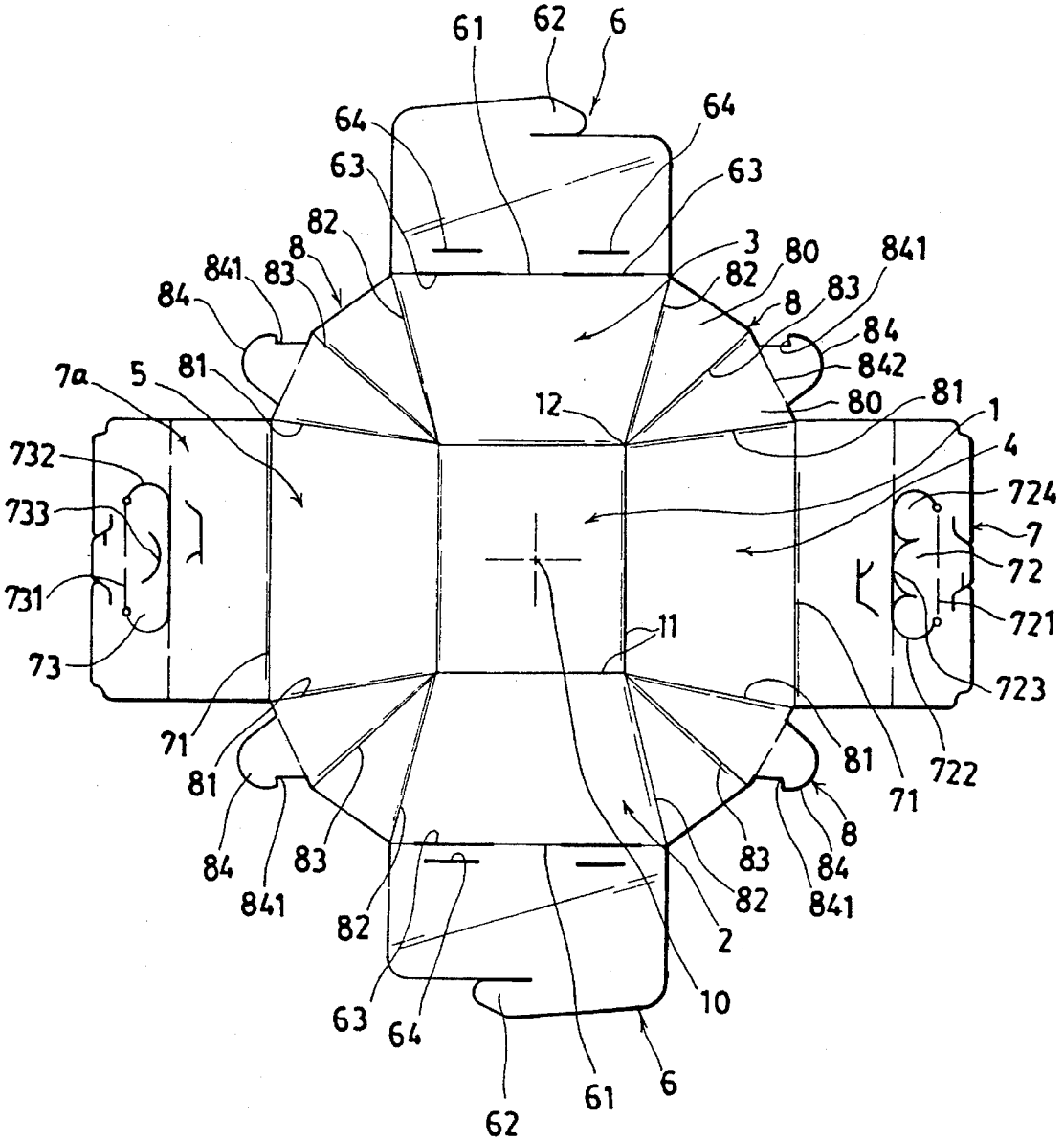
FIG. 1 is an exploded view of the present invention when unfolded as an one-piece board.

As shown in FIGS. 1–7, a foldable liquid container of the present invention comprises: a bottom wall 1 generally rectangular shaped; four side walls including a first side wall 2, a second side wall 3, a third side wall 4, and a fourth side wall 5 respectively hingedly secured to four side edge portions of the bottom wall 1 along four bottom tuck lines 11 each bottom tuck line 11 defining between each side edge portion of the bottom wall 1 and each side wall 2, 3, 4, 5; two half covers 6, 6 respectively hingedly secured to two opposite side walls 2, 3 for shielding a top opening la of the container when upwardly folding the side walls 2, 3, 4, 5 for forming the container of tetrahydron shape about a center 10 of the bottom wall 1; a first and a second handle member 7, **7*a* respectively hingedly secured to the other two opposite side walls 4, 5 and interlocked with each other for serving a handle for carrying the container when assembled; and four foldable web members 8 each web member 8 hingedly secured between every two neighboring side walls. The container can be integrally formed from an one-piece board as unfolded as shown in FIG. 1**.

Each side wall may be shaped as a rectangular, a square or a trapezoid shape, not limited in this invention.

Figure 2:
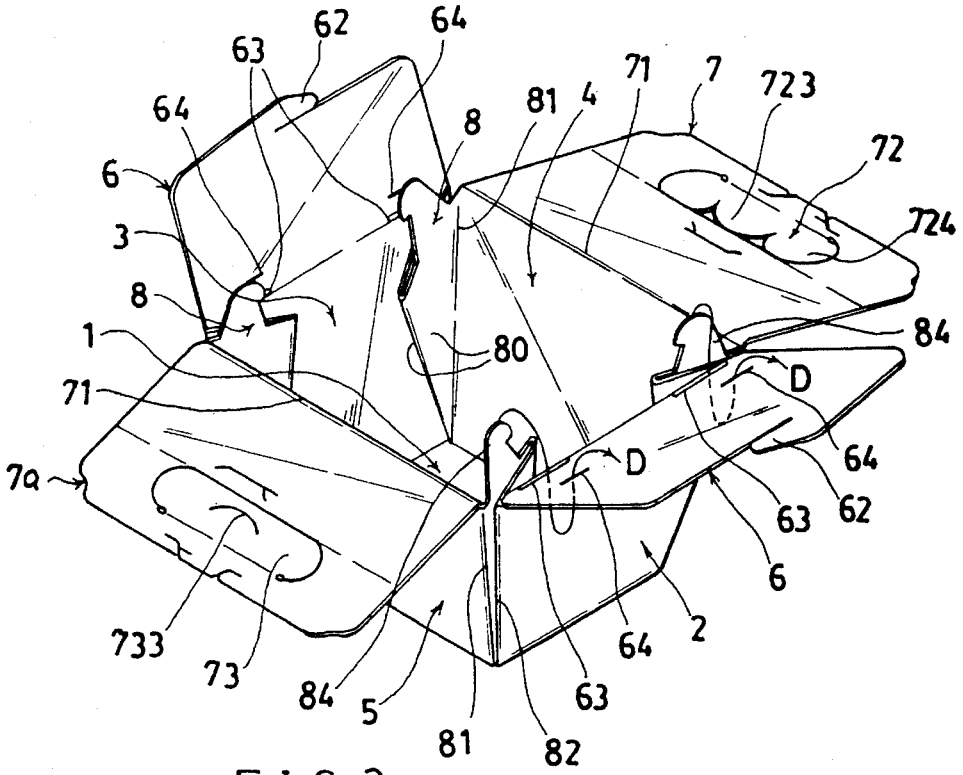
FIG. 2 shows a first step for erecting the container of the present invention by folding each foldable web member into the container.
Figure 3:
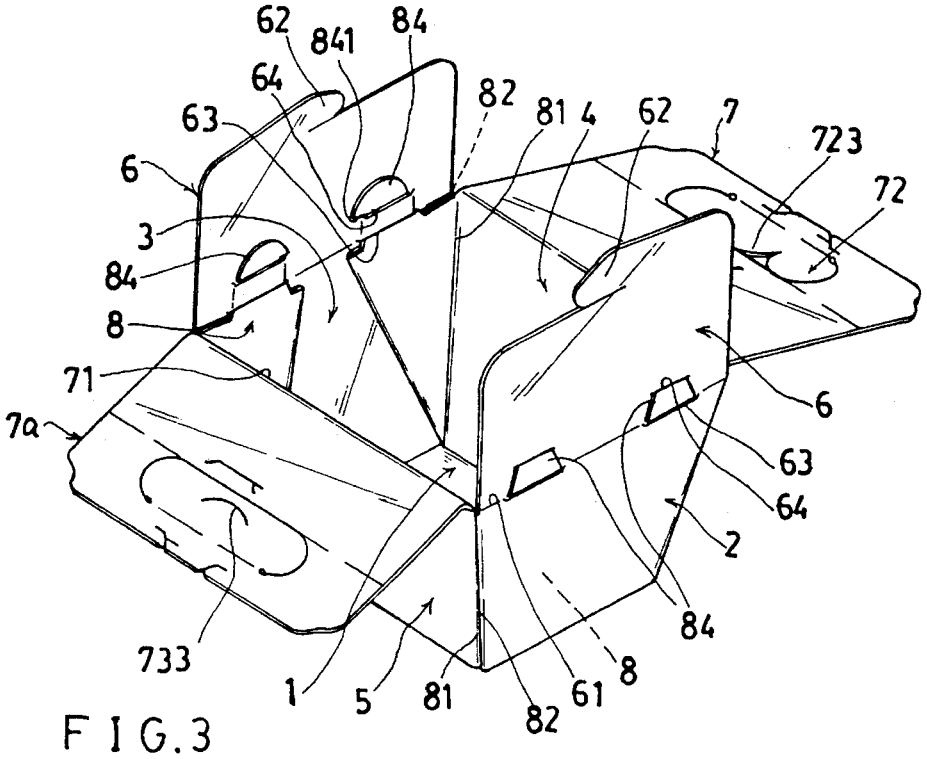
FIG. 3 shows a second step by inserting each tongue portion into the two slits of the half cover of the present invention.

Each half cover 6 includes: a cover tuck line 61 defining between the half cover 6 and the side wall 2 or 3, a finger portion 62 formed on an outer or upper portion of each half cover 6 for engaging the other finger portion 62 formed on the opposite-side half cover 6 for interlocking the two half covers 6 for cooperatively shielding the top opening la of the assembled container (FIG. 4), two sets of tongue slits 63, 64 cut in each half cover 6, each set of tongue slits including a lower slit 63 formed in the cover tuck line 61 between each cover 6 and each side wall 2 or 3 and an upper slit 64 positioned above the lower slit 63 when upwardly erecting each side wall and each half cover 6 as shown in FIGS. 2, 3 when setting up the container of the present invention.

The first handle member 7 includes: a handle tuck line 71 defining between the first handle member 7 and a side wall 4, and a male flap 72 interlockable with a female flap 73 formed in the second handle member **7*a* and including: a first flap tuck line 721 for hingedly removing the male flap 72 from a first cutout 722 cut in the first handle member 7, a male engaging protrusion 723 protruding outwardly from the male flap 72, and a pair of side flap portions 724 disposed on two side portions of the male engaging protrusion 723**.

Figure 5:
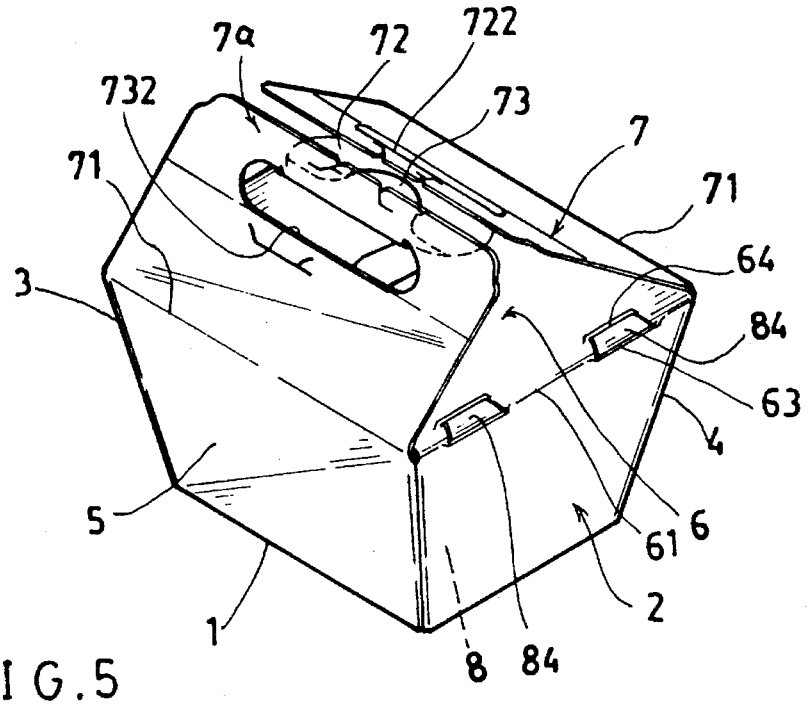
FIG. 5 shows a final step by interlocking two handle members of the container of the present invention for carrying purposes.

The second handle member **7*a* includes: a handle tuck line 71 defining between the second handle member 7*a* and another side wall 5 opposite to the side wall 4 secured with the first handle member 7, and the female flap 73 including: a second flap tuck line 731 for hingedly removing the female flap 73 from a second cutout 732 cut in the second handle member 7***a*, and a female slot 733 cut in the female flap 73 to be engaged with the male engaging protrusion 723 of the first handle member 7 for interlocking the first and second handle members 7, 7*a* for serving a handle for carrying the container when assembled as shown in FIG. 5.

Figure 6:
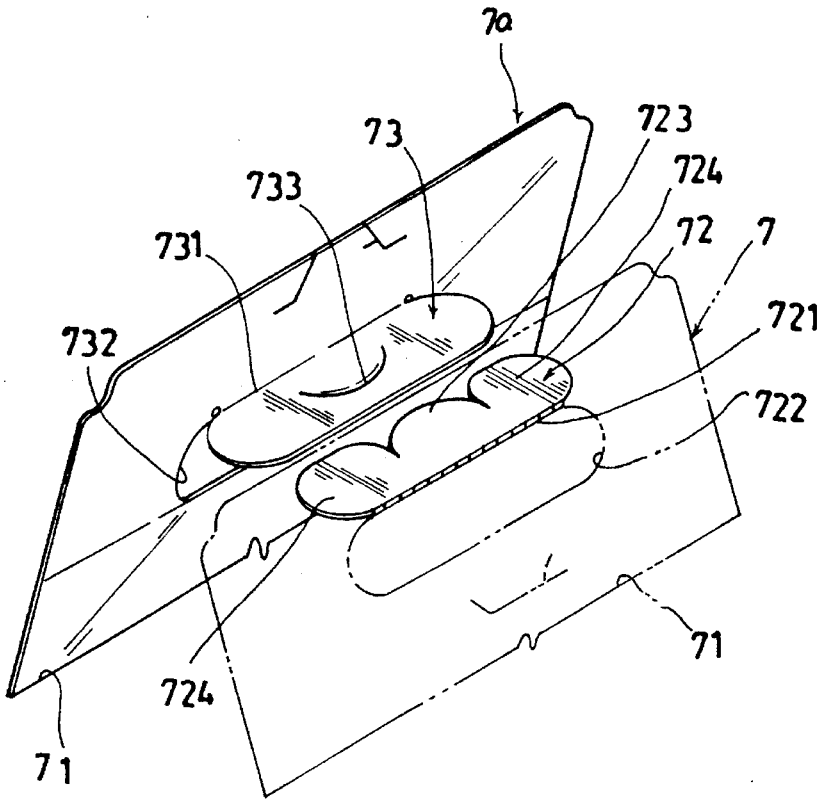
FIG. 6 is an illustration showing a pair of the interlockable flaps of the two handle members of the container of the present invention before being interlocked.
Figure 7:
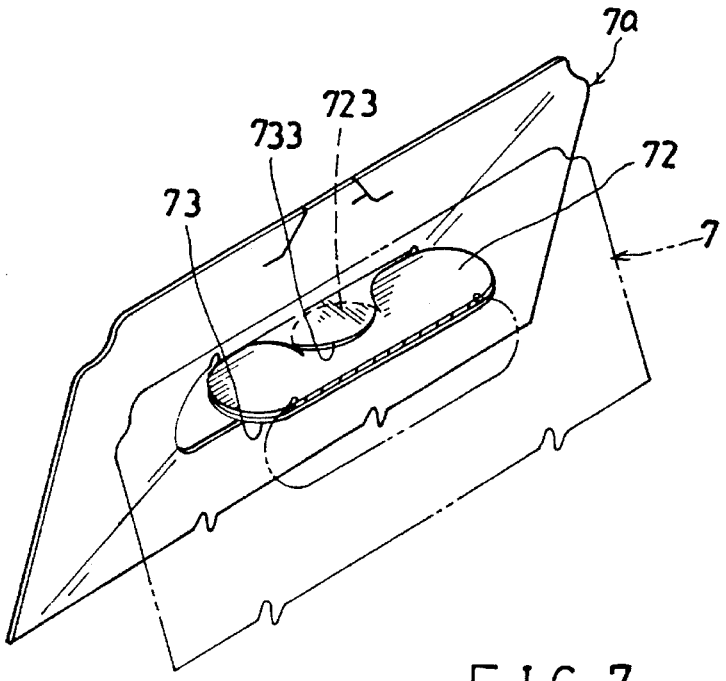
FIG. 7 is an illustration showing the two interlocked flaps of the present invention.

The male engaging protrusion 723 of the male flap 72 is formed as an arcuate shape convex outwardly as shown in FIG. 6, while the female slot 733 in the female flap 73 is formed as an arcuate slit convex outwardly to be interlockably engaged with the male engaging protrusion 723 as shown in FIG. 7. The two side flap portions 724 will be overlapped on the female flap 73 for a firm engagement between the two flaps 72, 73.

Figure 8:
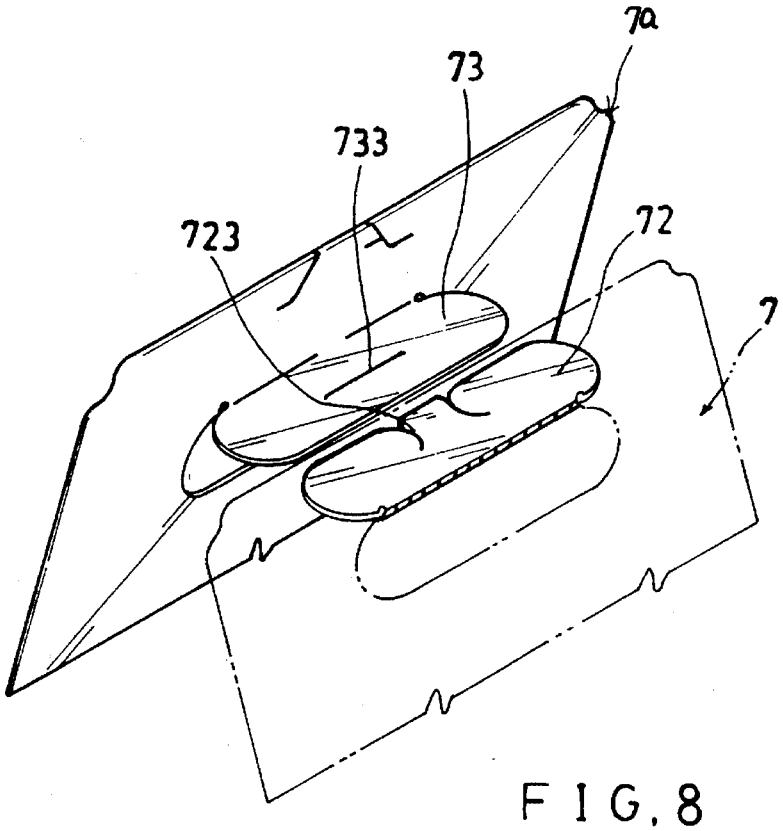
FIG. 8 shows another preferred embodiment of the pair of interlockable flaps of the present invention.
Figure 9:
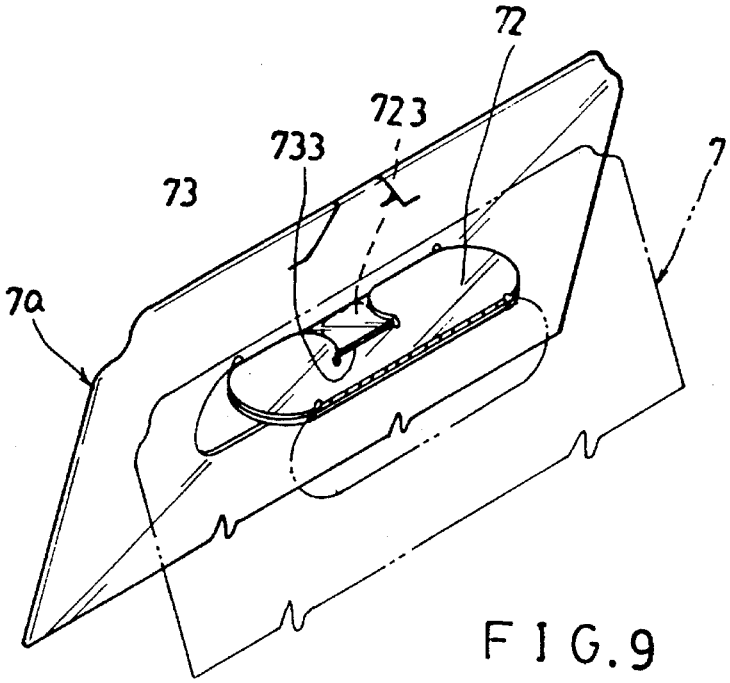
FIG. 9 shows the pair of flaps as interlocked from FIG. 8.

The male engaging protrusion 723 of the male flap 72 is formed as a pi-shaped (πshaped) convex outwardly as shown in FIG. 8, while the female slot 733 in the female flap 73 is formed as a linear slit parallel to a flat outer edge portion of the female flap 73 to be interlockably engaged with the male engaging protrusion 723 as shown in FIG. 9.

Figure 10:
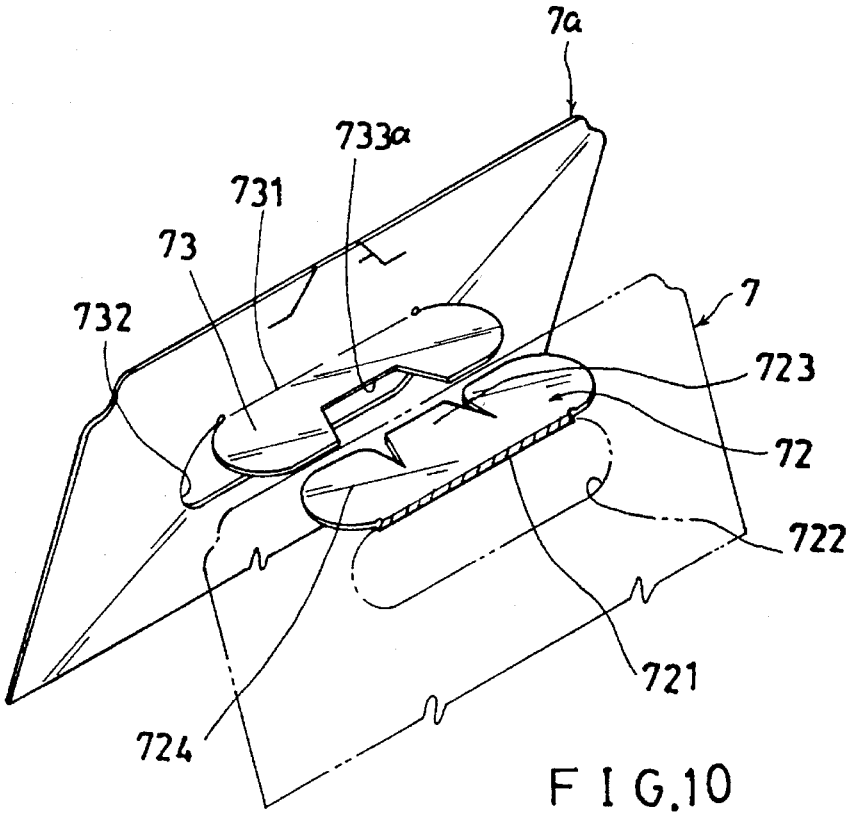
FIG. 10 shows still another preferred embodiment of the pair of interlockable flaps of the present invention.
Figure 11:
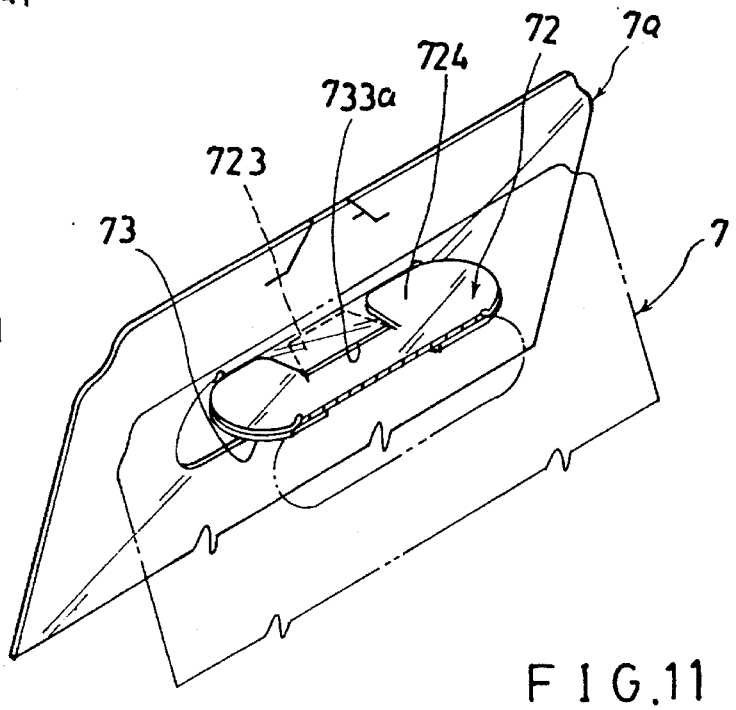
FIG. 11 shows the pair of flaps as interlocked from FIG. 10.

The male engaging protrusion 723 of the male flap 72 is formed as a trapezoid shape convex outwardly as shown in FIG. 10, while the female slot 733*a* is notched inwardly from an outer edge portion of the female flap 73 as shown in FIG. 10 to be interlockably engaged with the male engaging protrusion 723 as shown in FIG. 11.

Other modifications of the flaps 72, 73 may be made, not limited, in accordance with the present invention.

Each foldable web member 8 includes: two boundary tuck lines 81, 82 disposed on two longitudinal side edge portions to be contiguous to every two neighboring side walls such as between the two neighboring side walls 4, 2; the two side walls 4, 3; between side walls 5, 3; and between side walls 5, 2 as shown in FIG. 1; a diagonal tuck line 83 defining at a central portion of each web member 8 between the two boundary tuck lines 81, 82 to form two triangular sector portions 80, 80 each sector portion 80 defined between the diagonal tuck line 83 and a boundary tuck line 81 or 82, with the two boundary tuck lines 81, 82 and the diagonal tuck line 83 tapered inwardly to focus at a corner point 12 between every two neighboring bottom tuck lines 11 of the bottom wall 1; and a tongue portion 84 protruding outwardly upwardly from one triangular sector portion 80 adjacent to the side wall 4 (or 5) secured with the handle member 7 (or 7*a*), with the tongue portion 84 insertable in the lower and upper slits 63, 64 in the half cover 6 for interlocking each tongue portion 84 in each half cover 6 when upwardly erecting the side walls for setting up the container of the present invention as tetrahydron shaped as shown in FIG. 3.

Figure 4:
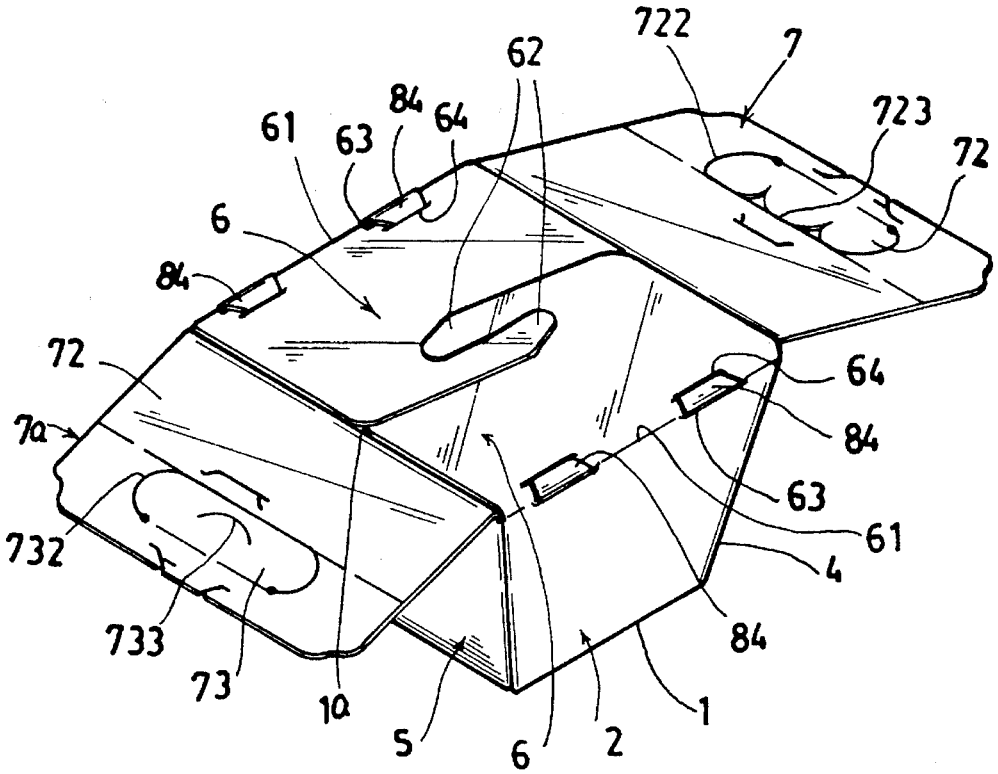
FIG. 4 shows a third step by shielding a top opening of the assembled container in accordance with the present invention.

The two half covers 6, 6 are bent inwardly and interlocked as shown in FIG. 4 for shielding the top opening 1*a* of the container, and the two handle members 7, 7*a* are also interlocked by engaging the male flap 72 with the female flap 73 as shown in FIG. 5 for carrying purpose.

Each tongue portion 84 of the web member 8 includes: a hook portion 841 protruding outwardly upwardly from a tongue tuck line 842 defined between each tongue portion 84 and each triangular sector portion 80 of the web member 8 with the hook portion 841 engageable with the upper slit 64 in the cover 6 when passing through the lower slit 63 as shown in FIG. 3. The tongue portion 84 is bent along the tongue tuck line 842 coincided with the cover tuck line 61 of the cover 6 so that the cover 6 and the tongue portions 84 can be smoothly bent as shown in FIG. 4.

Figure 12:
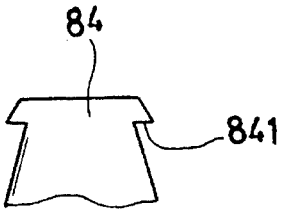
FIG. 12 shows another tongue portion of the present invention.
Figure 13:
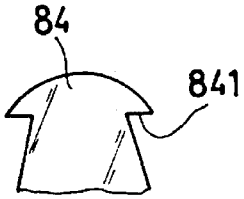
FIG. 13 shows still another tongue portion.

The hook portion may be modified to be an arrow as shown in FIGS. 12, 13 to be interlocked with the slits 63, 64 in the cover 6.

The present invention is superior to the prior art such as U.S. Pat. No. 1,985,111 with the following advantages:

1. Since the slits 63, 64 cut in the cover 6 are positioned above an upper edge of each side wall of the present invention, the container when set up can be provided for filling liquid materials such as liquid foods or beverage therein without leakage and also with a larger capacity or inner content within the container.
2. Each web member 8 is directly folded into the container for a quicker and simpler operation and construction without overlapping one web member to the other web member to prevent any tangling or obstruction whenever setting the container.

I claim:

1. A foldable container comprising:

a bottom wall generally rectangular shaped;

four side walls hingedly secured to four side edge portions of said bottom wall along four bottom tuck lines each said bottom tuck line defined between each side edge portion of the bottom wall and each said side wall;

two half covers respectively hingedly secured to two opposite side walls for cooperatively shielding a top opening of the container when upwardly folding and erecting said four side walls for forming the container as tetrahydron shaped, with each said half cover cut with at least two tongue slits therein;

two handle members respectively hingedly secured to the other two opposite side walls and interlocked with each other for carrying the container; and four foldable web members each web member hingedly secured between every two neighboring side walls, each said web member having a tongue portion protruding outwardly upwardly from said web member and insertable in a respective tongue slit cut in one said half cover secured to one of two neighboring side walls for interlocking each said web member to one said half cover when erecting said four side walls vertically on said bottom wall for setting up the container as tetrahydron shaped.

2. A foldable container according to claim 1, wherein each said half cover is formed with two sets of tongue slits therein, each set of said tongue slits including a lower slit formed in a cover tuck line between each said half cover and each said side wall and an upper slit positioned above the lower slit when upwardly erecting each said side wall and each said half cover when setting up the container.

3. A foldable container according to claim 1, wherein said first handle member includes: a first handle tuck line defining between the first handle member and a first side wall, and a male flap interlockable with a female flap formed in the second handle member and including: a first flap tuck line for hingedly removing the male flap from a first cutout cut in the first handle member, a male engaging protrusion protruding outwardly from the male flap, and a pair of side flap portions disposed on two side portions of the male engaging protrusion.

4. A foldable container according to claim 3, wherein said second handle member includes: a second handle tuck line opposite to said first handle tuck line and defining between the second handle member and a second side wall, and the female flap including: a second flap tuck line for hingedly removing the female flap from a second cutout cut in the second handle member, and a female slot cut in the female flap to be engaged with the male engaging protrusion of the first handle member for interlocking the first and second handle members for carrying the container when assembled.

5. A foldable container according to claim 4, wherein said male engaging protrusion of the male flap is formed as an arcuate shape convex outwardly and the female slot in the female flap is formed as an arcuate slit convex outwardly to be interlockably engaged with the male engaging protrusion.

6. A foldable container according to claim 4, wherein said male engaging protrusion of the male flap is formed as a pi-shaped convex outwardly and the female slot in the female flap is formed as a linear slit parallel to a flat outer edge portion of the female flap to be interlockably engaged with the male engaging protrusion.

7. A foldable container according to claim 4, wherein said male engaging protrusion of the male flap is formed as a trapezoid shape convex outwardly and the female slot is notched inwardly from an outer edge portion of the female flap to be interlockably engaged with the male engaging protrusion.

8. A foldable container according to claim 1, wherein each said foldable web member includes: two boundary tuck lines disposed on two longitudinal side edge portions of the web member; a diagonal tuck line defining at a central portion of said web member between the two boundary tuck lines to form two triangular sector portions each said triangular sector portion defined between the diagonal tuck line and each said boundary tuck line, with the two boundary tuck lines and the diagonal tuck line tapered inwardly to focus at a corner point intersecting each said bottom tuck line of the bottom wall; and said tongue portion protruding outwardly upwardly from one said triangular sector portion adjacent to one said side wall secured with each said handle member, with the tongue portion insertable in the tongue slit cut in the half cover for interlocking each said tongue portion in each said half cover when upwardly erecting the four side walls for setting up the container as tetrahydron shaped.

9. A foldable container according to claim 8, wherein each said tongue portion of the web member includes: at least a hook portion protruding outwardly upwardly from a tongue tuck line defined between said tongue portion and said triangular sector portion of the web member with the hook portion engageable with the upper slit in the cover when passing through the lower slit, said tongue portion operatively bent along the tongue tuck line coincided with a cover tuck line of the cover between the cover and one said side wall, whereby the cover and the tongue portion can be smoothly bent inwardly when closing the cover on the container.

* * * * *